United States Patent [19]

Jauch

[11] 4,036,004

[45] July 19, 1977

[54] CLOCK WITH STRIKING MECHANISM

[75] Inventor: Christian M. J. Jauch, Louisville, Miss.

[73] Assignee: Spartus Corporation, Chicago, Ill.

[21] Appl. No.: 671,143

[22] Filed: Mar. 29, 1976

[51] Int. Cl.[2] ..... G04B 21/06

[52] U.S. Cl. ..... 58/9; 58/13

[58] Field of Search ..... 58/8–13, 58/125

[56] References Cited

U.S. PATENT DOCUMENTS

| | | | |
|---|---|---|---|
| 2,127,635 | 8/1938 | Warshawsky | 58/8 |
| 2,851,850 | 9/1958 | Fowler | 58/13 |
| 3,520,126 | 7/1970 | Kolodliej | 58/8 |

FOREIGN PATENT DOCUMENTS

| | | | |
|---|---|---|---|
| 1,221,989 | 7/1966 | Germany | 58/9 |

*Primary Examiner*—E. S. Jackmon

*Attorney, Agent, or Firm*—Merriam, Marshall, Shapiro & Klose

[57] ABSTRACT

A clock has a striking mechanism separate and discrete from the clock mechanism. The two mechanisms are located in side-by-side relation and aligned by a pin common to both mechanisms. The striking mechanism comprises striking means and control means, for limiting the strikes to a predetermined number corresponding to the particular time indicated by the clock. Both the striking means and the control means are actuated, through respective linkages, by a driven gear pivotable between a driven position in which the driven gear is in meshing engagement with a constantly rotating gear, driven by the clock mechanism, and a disengaged undriven position. Part of the control means on the striking mechanism is synchronized for continuous movement with the hour hand shaft on the clock mechanism using a linking gear mounted on the pin common to both the clock mechanism and striking mechanism.

20 Claims, 8 Drawing Figures

CLOCK WITH STRIKING MECHANISM

BACKGROUND OF THE INVENTION

The present invention relates generally to clocks and more particularly to a clock having a striking mechanism which, at the hour, strikes a chime rod, bell or the like a predetermined number of times corresponding to the particular hour position of the clock's hour hand and which also strikes at fractions of the hour.

Conventionally, a clock which strikes the hour comprises a striking mechanism having striking means for causing a sound and control means which limits strikes to a predetermined number corresponding to the particular hour position of the clock's hour hand. Typically, such control means includes a snail cam having 12 steps and rotated in synchronism with rotation of the hour hand shaft. Conventionally, to synchronize the rotation of the snail cam with the hour hand shaft, the snail cam was mounted on the hour hand shaft. A drawback to this arrangement was that the snail cam, and associated structure in the striking mechanism, had to be mounted in front of the clock mechanism, thereby, of necessity, increasing the thickness dimensions of the clock, which was undesirable from the standpoint of aesthetics and design flexibility.

Another drawback of such an arrangement was that the striking mechanism, or at least a substantial part thereof, had to be constructed integrally with the clock mechanism, rather than providing a striking mechanism which was separate and discrete from the clock mechanism. With separate and discrete mechanisms, the same clock mechanism can be used with or without a striking mechanism, thereby decreasing tooling and manufacturing costs compared to a less versatile clock mechanism.

A further drawback of the conventional arrangement described above was that it required a relatively large number of parts connected together in a complicated arrangement.

SUMMARY OF THE INVENTION

In accordance with the present invention there is provided a clock having a striking mechanism which is separate and discrete from the clock mechanism and which may be mounted alongside the clock mechanism rather than in front of it. Each of the two separate mechanisms has at least one mounting plate.

The snail cam in the control means of the striking mechanism is mounted for rotation on a shaft displaced from the hour hand shaft of the clock mechanism, but the snail cam rotates in synchronism with the hour hand shaft. The snail cam is driven by gear means, located on the striking mechanism, and in turn driven by a linking gear mounted for rotation about the axis of a pin which extends through the mounting plate of the striking mechanism. This same pin is received in an opening in the mounting plate of the clock mechanism, thereby to align the two mechanisms and accurately mesh the linking gear on the striking mechanism with a constantly rotating gear on the clock mechanism in turn driven by the same gear means that rotates the hour hand shaft.

For the purpose of starting and stopping the striking means, there is provided a driven gear mounted for pivotal movement between a first position for engaging a constantly rotating gear and a second position disengaged from the constantly rotating gear. Linking structure is provided so that, when the pivotable driven gear is in its first position (engaged with the constantly rotating gear), the striking means is actuated, but, when the pivotable driven gear is in its disengaged second position, the striking means no longer operates. When the minute hand shaft is either at the half-hour position or at an hour position, the driven gear is pivoted from its second to its first position and, upon completion by the striking means of the predetermined number of strikes, the driven gear is pivoted back from its first to its second position.

The entire arrangement is driven by a conventional synchronous electric motor, e.g., the type powered by conventional 60-cycle AC current. This renders extremely reliable the movement of all the parts in the desired synchronism.

The striking mechanism is relatively small and, for the functions it performs, has a relatively small number of parts due to the particular selection of the individual parts combined to perform those functions.

Other features and advantages are inherent in the structure claimed and disclosed or will be apparent to those skilled in the art from the following detailed description in conjunction with the accompanying diagrammatic drawing.

DETAILED DESCRIPTION

Figure 1:
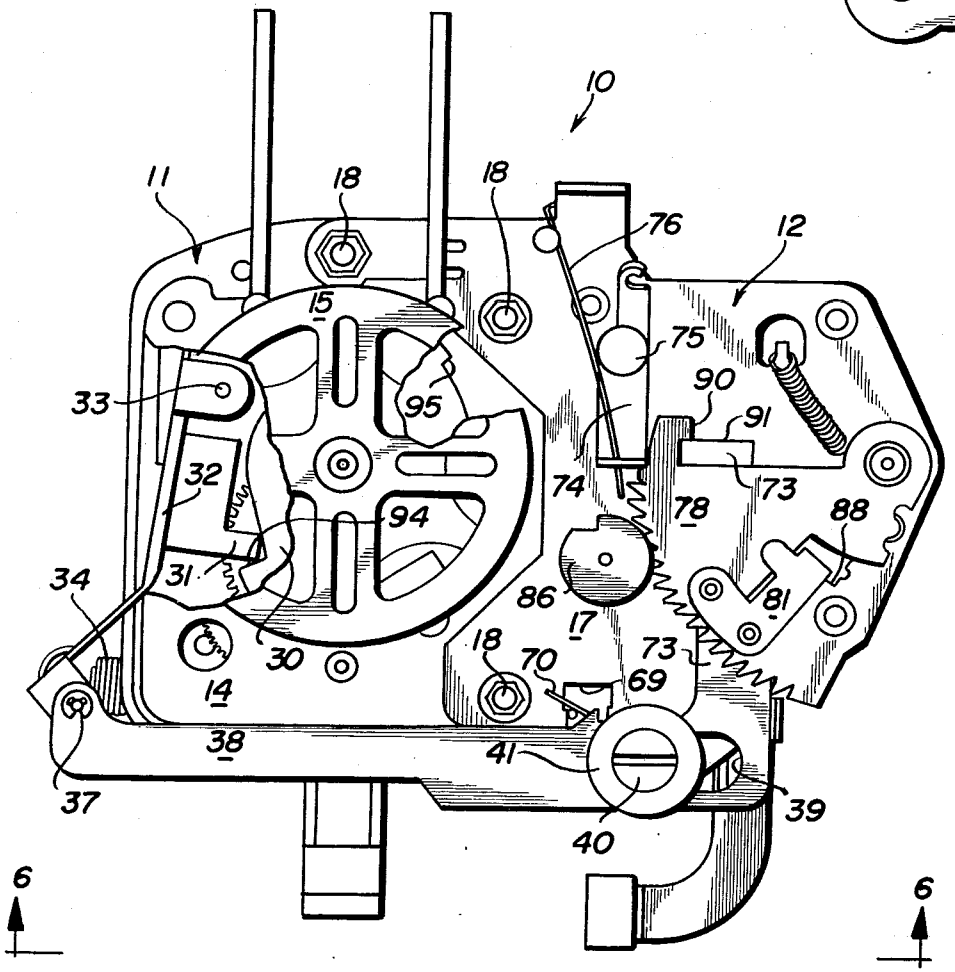
FIG. 1 is a rear view of the interior of a clock comprising a clock mechanism, partially cut away, and a striking mechanism construced in accordance with an embodiment of the present invention.
Figures 5, 6:
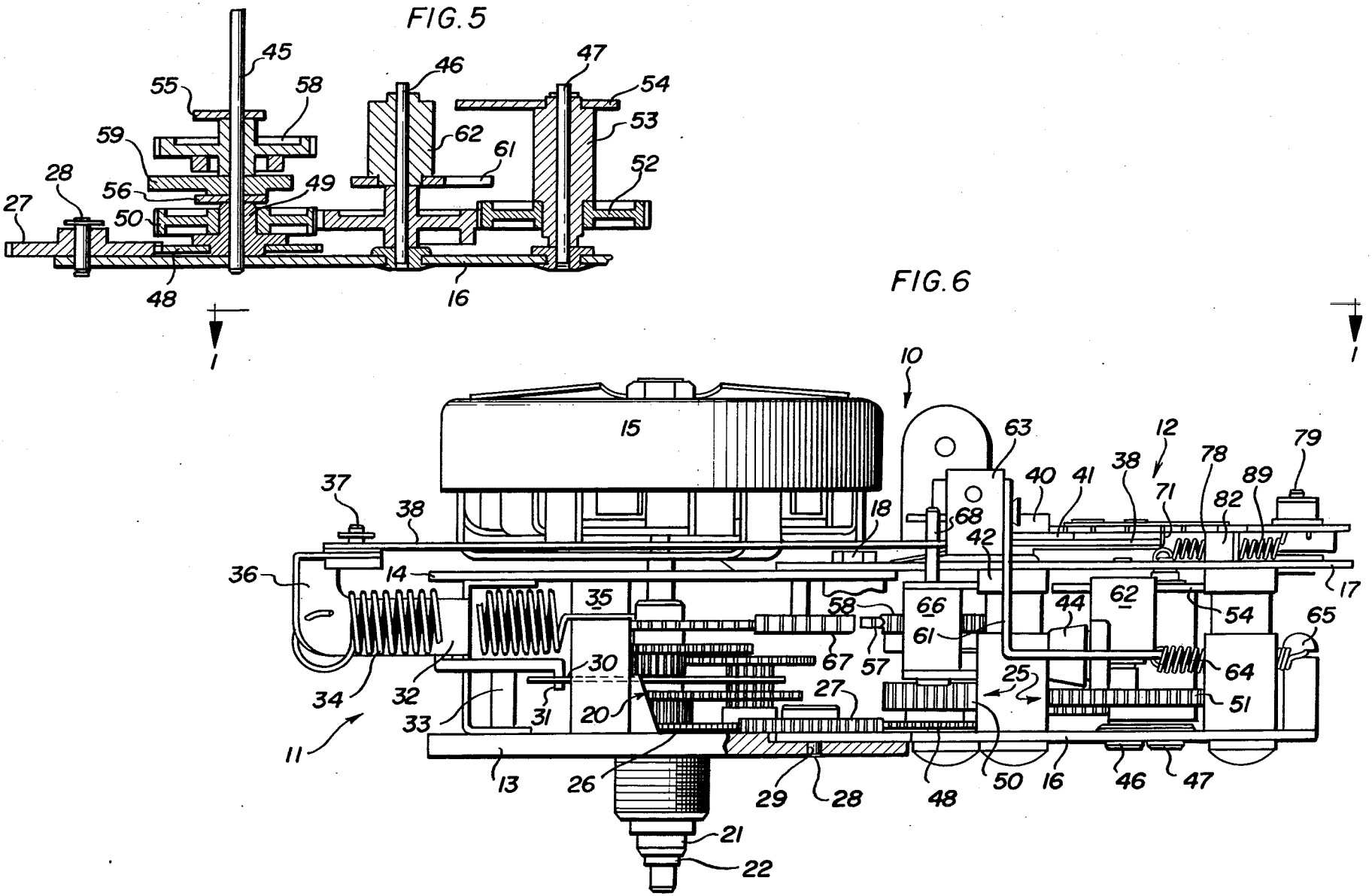
FIG. 5 is a sectional view taken along line 5—5 in FIG. 4.
FIG. 6 is a side view of the clock interior.

Referring initially to FIGS. 1 and 6, a clock indicated generally at 10 comprises a clock mechanism 11 and a striking mechanism 12 separate and discrete from clock mechanism 11 and located alongside the clock mechanism. Clock mechanism 11 comprises front and rear plates 13, 14 respectively, and striking mechanism 12 comprises front and rear plates 16, 17 respectively. Fastening means 18 connect together the corresponding front and rear plates of the clock and striking mechanisms 11, 12.

Mounted on rear plate 14 of clock mechanism 11 is a synchronous electric motor 15 of conventional construction powered by conventional 60-cycle AC current, for example. Motor 15 drives first gear means 20 located on clock mechanism 11 between front and rear plates 13, 14 thereof. Gear means 20 in turn drives hour hand shaft 21 and minute hand shaft 22 both located in front of front plate 13 of clock mechanism 11 (FIG. 6).

Mounted on striking mechanism 12, between front and rear plates 16, 17 thereof, are second gear means indicated generally at 25. Located on clock mechanism 11 is a further gear 26 which, by virtue of being driven through first gear means 20 by synchronous electric motor 15, rotates continuously at a constant speed. Located on striking mechanism 12 as part of second gear means 25 is a linking gear 27 which meshes with gear 26 on clock mechanism 11.

Structure is provided to assure an accurate meshing engagement of linking gear 27 with continuously rotating gear 26 when the striking mechanism 12 is attached to the clock mechanism 11 in side-by-side relation. This structure comprises a pin 28 mounted on the striking mechanism's front plate 16 and an opening 29 in the clock mechanism's front plate 13. Pin 28 is received in opening 29 when the two mechanisms are assembled together and, in effect, constitutes an axis of rotation for a gear on the clock mechanism and an axis of rotation for a gear on the striking mechanism, the axis of rotation on both mechanisms being identical in this particular case. In this manner, second gear means 25 on striking mechanism 12 is correctly located in relation to first gear means 20 on clck mechanism 11.

Fastened to minute hand shaft 22 so as to rotate with it, is a cam 30 consisting of two steps, 180° apart, a short step 95, and a long step 94 extending outward further than short step 95. Riding against cam 30 is a cam follower 31 attached to a lever 32 having one end pivoting on a pin 33 mounted to clock mechanism front plate 13. Cam follower 31 is held against cam 30 by the urging of a spring 34 having one end engaging the end 36 of lever 32 opposite pin 33 and another end attached to a post 35.

Lever end 36 carries a pin 37 on which is pivotally mounted one end of a slide member 38 having a horizontally elongated slot 39 at its other end. Slide member 38 is retained alongside striking mechanism 12 by a shoulder screw 40 extending through a washer 41 and slot 39 into a threaded opening in a post 42 located between front and rear plates 16, 17 of striking mechanism 12.

As cam 30 rotates with the minute hand shaft, lever 32 moves outward, to the left in FIG. 1, carrying slide member 38 with it.

Extending between the front and rear plates 16, 17 of striking mechanism 12 are three shafts 45, 46, 47. Freely rotatable on shaft 45 is a gear 48 having a hub 49 on which is mounted a gear 50 rotatable with gear 48. Freely rotatable about shaft 46 is a gear 51, and freely rotatable about the axis of shaft 47 is a gear 52 fixed on a hub 53 on which is fixed a snail cam 54.

Linking gear 27 drives gear 48, hub 49 and gear 50 on shaft 45. Gear 50 drives gear 51 on shaft 46, and gear 51 drives gear 52, hub 53 and snail cam 54 on shaft 47.

Linking gear 27 is in mesh with the hour hand gear 26 of the clock mechanism. All of said gears 26, 27, 48, 50, 51, 52 are intermeshed and of such a ratio that as the clock mechanism runs, gear 52 and snail cam 54 rotate in step with, and at the same speed as, hour gear 26, i.e., one revolution in 12 hours.

Figure 4:
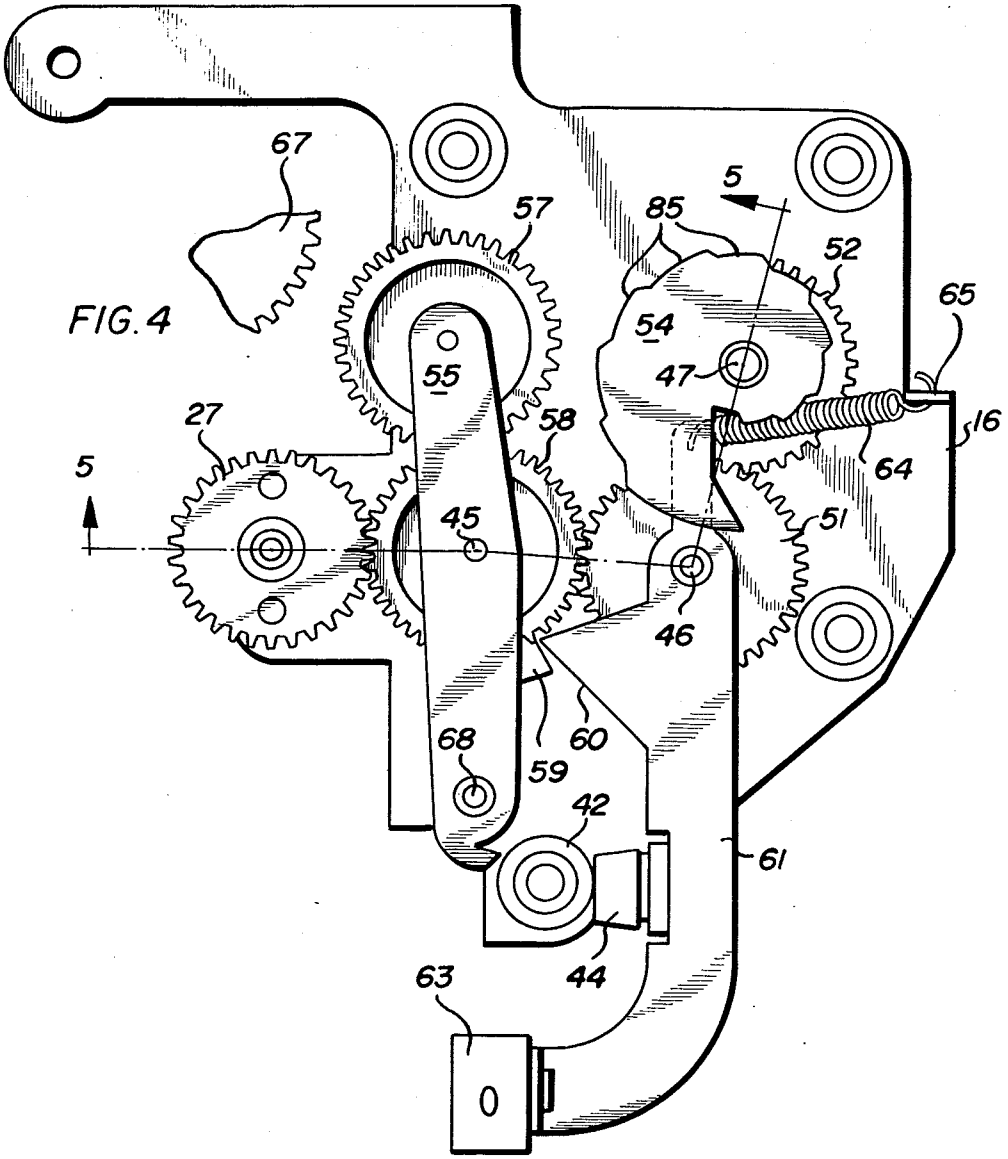
FIG. 4 is a rear view of the striking mechanism with some of its parts removed.
Figure 3:
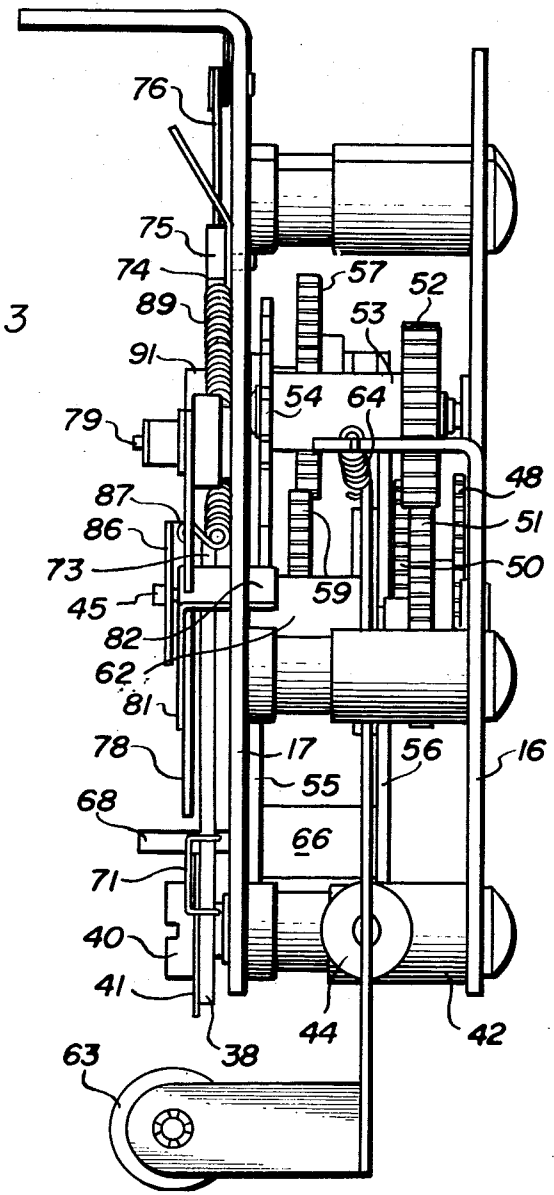
FIG. 3 is a side view of the striking mechanism.

Rotatably mounted on shaft 45 are a pair of vertically spaced arms 55, 56. Rotatably mounted between one end of arms 55, 56 is a gear 57 (FIG. 4). Also located between arms 55, 56 are a gear 58 and a cam 59 both fixed to shaft 45. Gear 57 drives gear 58 which turns shaft 45 to drive cam 59 which, on each rotation engages a projection 60 on a striking lever 61 pivotally mounted on a hub 62 fixed on shaft 46. One end of striking lever 61 carries a hammer 63 for striking a chime rod or the like (not shown), and the other end of striking lever 61 is attached to one end of a spring 64 having its other end attached to a tab 65 on front plate 16 of the striking mechanism. Striking lever 61 pivots in a counterclockwise sense, as viewed in FIG. 4, at the urging of cam 59 and then returns in a clockwise sense due to the urging of spring 64, once for every revolution of cam 59. A rubber bumper 44 on striking lever 61 bumps against post 42 on the striking lever's return movement.

Figure 2:
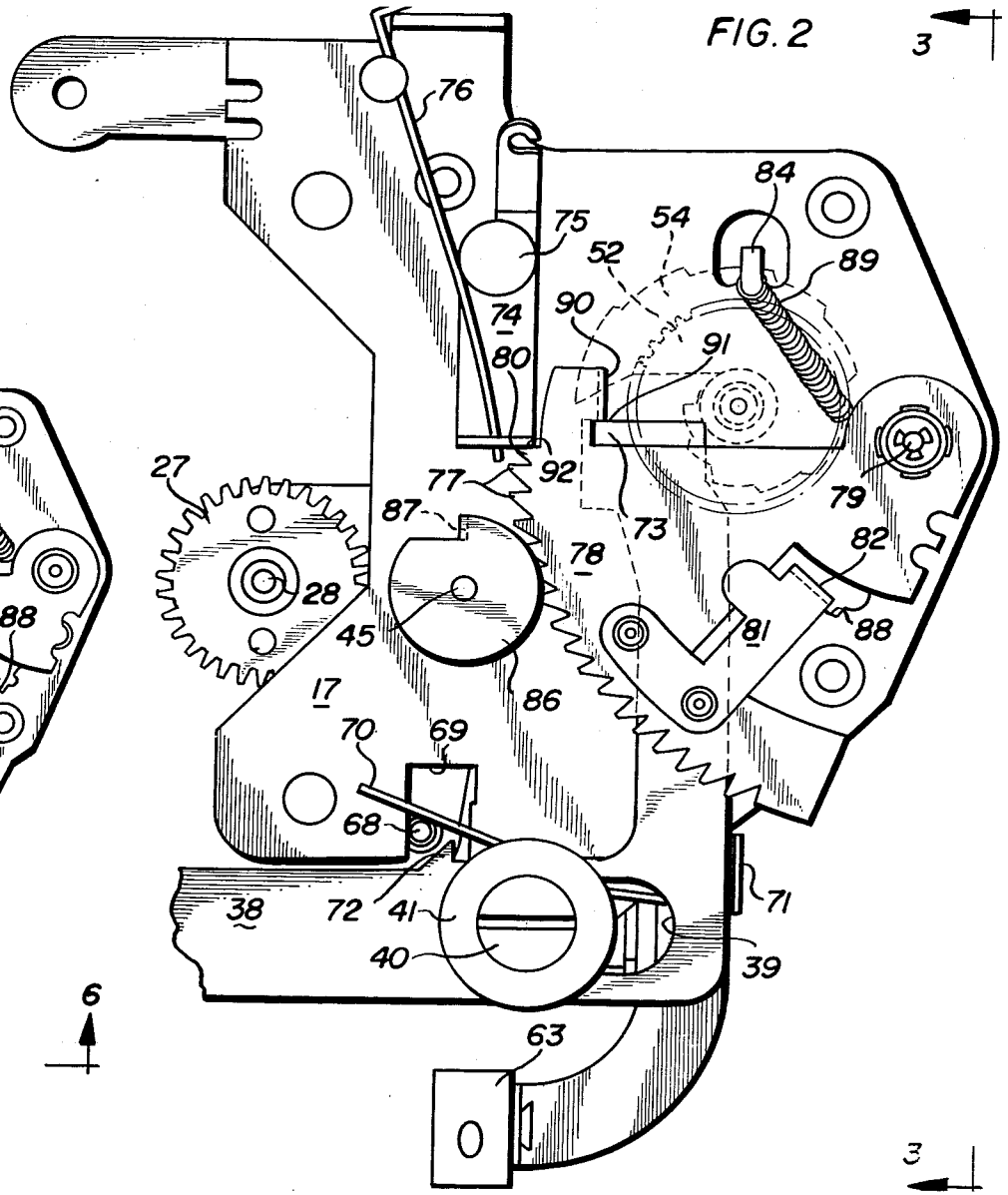
FIG. 2 is a rear view of the striking mechanism alone.

Located between arms 55, 56, at the ends thereof opposite gear 57, is a spacer plug 66 mounted on a pin 68. Arms 55, 56 are free to rotate about shaft 45 and, when rotated counterclockwise as viewed in FIG. 4, carry gear 57 into meshing engagement with a constantly rotating gear 67 in clock mechanims 11 (FIGS. 5 and 6). The amount that arms 55, 56 rotate is controlled by pin 68 which extends through a slot 69 (FIG. 2) cut into rear plate 17 of the striking mechanism. Arms 55, 56 and gear 57 are retained in a clockwise location as viewed in FIG. 4 (disengaged from constantly rotating gear 67) due to the urging of a spring finger 70 bearing against pin 68 (FIG. 2). Spring finger 70 has an end portion 71 attached to slide member 38.

As previously explained, cam 30 on the minute hand shaft causes lever 32 to move outwardly and thus move slide member 38 to the left, as viewed in FIG. 2. Because of the clearance between shoulder screw 40 and slot 39, slide member 38 is free to move up and down a small amount as viewed in FIG. 2. This movement of slide member 38 is sufficient to allow a projection 72 thereon to move under and to the left of pin 68 as slide member 38 moves to the left in FIG. 2.

When cam 30 has rotated sufficiently to cause follower 31 to fall off one of the cam steps 94, 95, lever 32 is moved to the right in FIG. 1, by the urging of spring 34, in turn moving slide member 38 to the right. Projection 72 now engages pin 68, pushing pin 68 to the right and rotating arms 55, 56 counterclockwise in FIG. 4 so as to mesh gear 57 with constantly rotating gear 67 on the clock mechanism.

Figure 8:
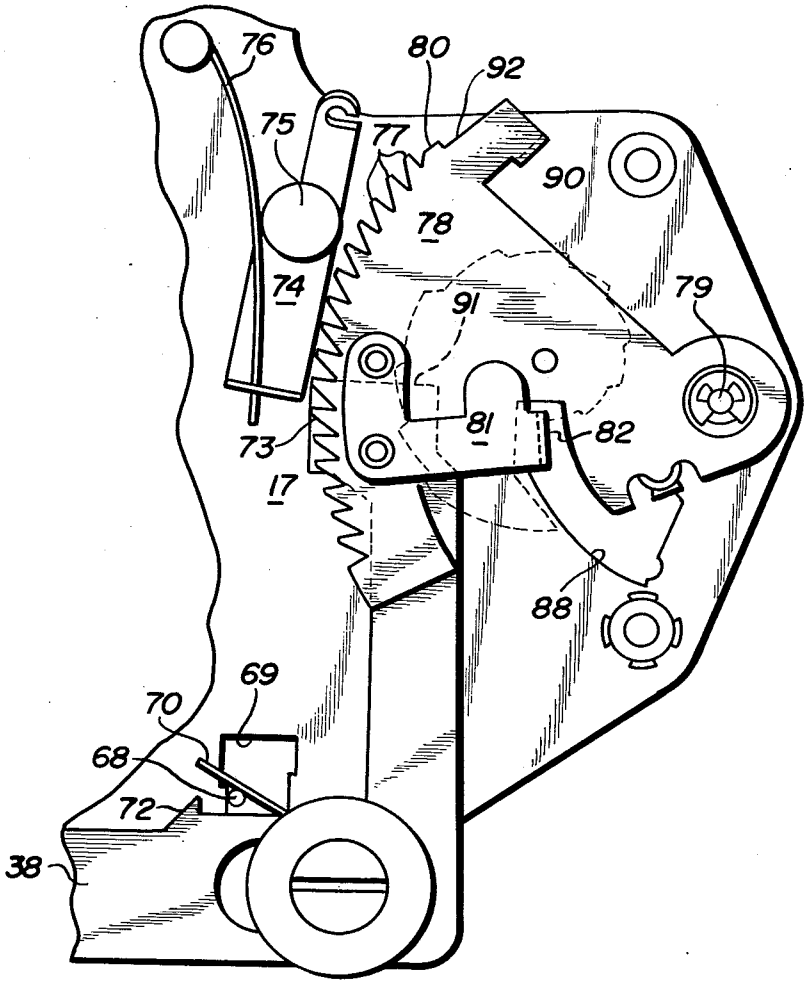
FIG. 8 is a partial rear view of the striking mechanism showing the disposition of the parts at 12 o'clock.
Figure 7:
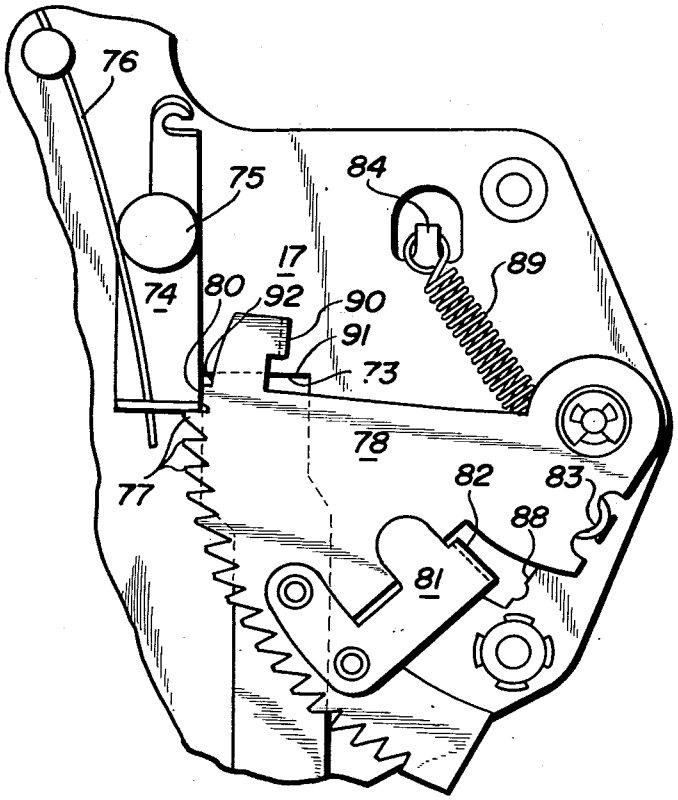
FIG. 7 is a partial rear view of the striking mechanism showing the disposition of some of its parts at the half-hour.

Referring to FIGS. 2, 7 and 8, an upward extension 73 of slide member 38 is positioned to contact a latch 74 pivotally mounted at 75 to rear plate 17. Latch 74 is normally urged by a spring 76 into engagement with the periphery of a rack 78 pivotally mounted at 79 to rear plate 17. Rack 78 is normally urged by a spring 89 to pivot in a clockwise sense in FIGS. 2, 7 and 8, but such pivotal movement is prevented by the engagement of latch 74 with the rack's periphery comprising a plurality of full teeth 77, a partial or half tooth 80 and an untoothed portion 92.

When slide member 38 moves to the left, as viewed in FIGS. 2 and 8, the slide member's upward extension 73 engages latch 74 and pivots the latch from engaging positions for engaging untoothed rack portion 92 (FIG. 2) or the peripheral gear teeth 77, 80 on rack 78 (FIG. 7) to a disengaged position shown in FIG. 8.

Rack 78 is mounted for movement about pivotal axis 79 between a first position shown in FIG. 2 and a pluarlity of positions displaced from the position of FIG. 2 in a clockwise sense. Two such displaced positions are shown in FIGS. 7 and 8. There are twelve displaced positions, in all: one for the half-hour and 1 o'clock (FIG. 7) and one for each of the eleven remaining hour positions on the clock (the 12 o'clock position being shown in FIG. 8).

Rack 78 is urged in a clockwise sense, as viewed in FIGS. 2, 7 and 8, by a spring 89 having one end attached to rack 78 at 83 and another end attached to a tab 84 on plate 17 (FIG. 7). Pivotal movement of rack 78 in a clockwise sense, upon complete disengagement of latch 74 from rack teeth 77, 80, is limited to a displaced position determined by the position of the hour hand shaft on the clock mechanism, utilizing structure now to be described.

Mounted on rack 78 is an element 81 (FIGS. 1, 2 7 and 8) from which depends a tab 82 extending through a slot 88 in plate 17 for engaging with one of the steps 85 on snail cam 54 (FIG. 4). As previously described, snail cam 54 is synchronized for movement with the hour hand shaft of the clock mechanism. Each of the steps 85 on snail cam 54 is spaced a different radial distance from the pivotal axis 47 of the snail cam. The cam step spaced the longest radial distance from pivotal axis 85 of snail cam 54 corresponds to a time of 1 o'clock for the hour hand, and the cam step spaced the shortest raidal distance from the pivotal axis of the snail cam corresponds to a time of 12 o'clock for the hour hand.

Pivotal movement of rack 78 in a clockwise sense is limited the most when tab 82 engages the step on snail cam 54 spaced the longest radial distance from the pivotal axis of the snail cam, and pivotal movement of rack 78 in a clockwise sense is limited the least when tab 82 engages the step on snail cam 54 spaced the least radial distance from the pivotal axis of the snail cam.

Rack 78 is returned, in a counterclockwise sense, to its first position (FIG. 2) by a disc 86 mounted on shaft 45 and having a tab 87 depending therefrom for engaging the full peripheral gear teeth 77 of rack 78 as disc 86 rotates in a clockwise sense with shaft 45, as viewed in FIG. 2. Each time tab 87 engages one of the peripheral gear teeth 77 or rack 78, rack 78 rotates in a counterclockwise sense a distance equal to the space between two adjacent gear teeth 77 on the rack. Latch 74 is urged by spring 76 against rack teeth 77, 80 to prevent return rotation of the rack in a clockwise sense while tab 87 is disengaged from the rack teeth.

Disc 86 rotates with shaft 45. As previously explained, cam 59 (for actuating striking lever 61) also rotates with shaft 45 in turn driven by gear 58 in turn driven by gear 57 mounted on arms 55, 56 which carry gear 57 into meshing engagement with the constantly rotating gear 67 on the clock mechanism when slide member 38 moves to the right (as viewed in FIGS. 1 and 2) and projection 72 on slide member 38 engages pin 68. Gear 57 is disengaged from meshing engagement with constantly rotating gear 67 by structure now to be described, and this, in turn, stops the operation of cam 59 (operating striking lever 61) and disc 86 (rotating rack 78).

Referring to FIGS. 1 and 2, rack 78 has a depending tab 90. When rack 78 is pivoted counterclockwise until its untoothed peripheral portion 92 is engaged by latch 74, tab 90 engages the end 91 of upward extension 73 on slide member 38 causing the slide member to pivot downward about pin 37 (FIG. 1). This motion moves the slide member's projection 72 out of the path of pin 68 allowing spring finger 70 (FIG. 2) to rotate arms 55, 56 in a clockwise sense (FIG. 4), thereby moving attached gear 57 out of meshing engagement with constantly rotating clock gear 67 and preventing further rotation of gear 57. This, in turn, prevents further rotation of gear 58 and associated shaft 45, cam 59 and disc 86.

Following is the sequence of operations which occur in striking the half-hour. As minute hand shaft 22 rotates with cam 30 from zero to thirty minutes, cam follower 31 climbs the short step 95 of cam 30 (FIG. 1). This pivots lever 32 in a clockwise sense and moves slide member 38 part way to the left (FIGS. 1 and 2) Such movement causes the slide member's upward extension 73 to pivot latch 74 out of engagement with untoothed portion 92 on rack 78 (FIG. 2) and engage half-tooth 80 (FIG. 7). Rack 78 is thus cocked to control the striking of the half-hour.

When the minute hand shaft reaches thirty minutes, follower 31 drops off short step 95 on cam 30, causing slide member 38 and its projection 72 to move to the right under the urging of spring 34 (FIGS. 1 and 2). Projection 72 engages pin 68 and pivots arms 55, 56 with gear 57 into meshing engagement with constantly rotating gear 67 on the clock mechanism (FIG. 4). Through a linkage described above, gear 57 drives disc 86 and cam 59 which rotate together. One rotation of cam 59 raises and releases striking lever 61 once (FIG. 4). Referring to FIG. 2, one rotation of disc 86 brings tab 87 into engagement with a full tooth 77 on rack 78 to rotate rack 78 counterclockwise one tooth, thereby bringing latch 74 back into engagement with untoothed portion 92 on rack 78.

When rack 78 has been rotated counterclockwise so that latch 74 engages the untoothed peripheral portion 92 of rack 78, tab 90 on rack 78 pushes down on end 91 of the slide member's upward extension 73 (FIG. 2). This disengages projection 72 from pin 68 causing arms 55, 56 with gear 57 to be urged by spring 70, away from a position of meshing engagement of gear 57 with constantly rotating gear 67. Gear 57 thus (a) stops driving cam 59 after one strike by striking lever 61 and (b) stops driving disc 86 after one engagement thereof with a tooth 77 on rack 78.

Following is the sequence of operations which occurs when striking the hour. As previously noted, snail cam 54 makes one full rotation every 12 hours, and one of its 12 steps is interposed in the path of tab 82 on rack element 81 during each of the twelve respective numbered hours, the radially closest step being interposed just prior to 12 o'clock, and the radially furthest step being interposed just prior to 1 o'clock.

As minute hand shaft 22 rotates with cam 30 between thirty minutes and one hour, cam follower 31 climbs long step 94 on cam 30, and slide member 38 is moved to the left causing its upward extension 73 to pivot latch 74 completely out of engagement with rack 78 which is thus released to pivot in a clockwise sense until rack tab 82 engages the interposed step 85 on cam 54 appropriate for the particular approaching hour. Rack 78 is thus cocked to control the striking of the hour (FIG. 8).

Slide member 38 is moved further to the left, when cam follower 31 climbs long step 94 on cam 30, than when follower 31 climbed short step 95 on cam 30. This accounts for latch 74 being pivoted out of engagement with all teeth on rack 78 between thirty minutes and the hour (FIG. 8), whereas latch 74 remained in engagement with half-tooth 80 between zero and thirty minutes (FIG. 7) when follower 31 was climbing the short step on cam 30.

When the minute hand shaft reaches the hour, cam follower 31 drops off long step 94 on cam 30, causing slide member 38 and projection 72 to move to the right against pin 68, thereby pivoting arms 55, 56 in a counterclockwise sense (FIG. 4) to engage gear 57 with constantly rotating gear 67 to drive cam 59 and disc 86 through linkage described above. One rotation of cam 59 raises and releases striking lever 61 once. Cam 59 rotates the same number of times as disc 86 whose rotations equal the number of teeth 77 on rack 78 which tab 87 on disc 86 engages, in turn determined by the particular step 85 on 12-step cam 54 that is interposed in the path of tab 82 on rack 78.

Each rotation of disc 86 and cam 59 results in one complete strike cycle of striking lever 61. Latch 74 was returned to engagement with teeth 77 on rack 78 when slide member 38 moved to the right, and this engagement prevents clockwise movement of rack 78 (under urging of spring 89) after rack 78 is moved counterclockwise one notch by tab 87 on disc 86.

When rack 78 has been rotated counterclockwise so that latch 74 engages untoothed peripheral portion 92 of rack 78, tab 90 on rack 78 pushes down on end 91 of the slide member's upward extension 73, thereby disengaging projection 72 from pin 68 and causing arms 55, 56 to be urged by spring 70 to disengage driven gear 57 from constantly rotating gear 67, so that gear 57 stops driving cam 59 and disc 86, thus stopping the striking of striking lever 61 and the turning of rack 78.

The foregoing detailed description has been given for clearness of understanding only, and no unnecessary limitations should be understood therefrom, as modifications will be obvious to those skilled in the art.

What is claimed is:

1. In a clock having an hour hand shaft and a minute hand shaft:
striking means operable to cause a sound;
control means actuable to limit to a predetermined number the strikes made by said striking means;
a constantly rotating gear;
a driven gear;
means mounting said driven gear for movement between a first position, in which said driven gear is in engagement with said constantly rotating gear, and a disengaged second position;
means normally urging said driven gear to said disengaged second position;
means, responsive to the minute hand shaft attaining the hour position, for moving said driven gear to its first position;
drivable means, driven by said driven gear when the latter is in its first position, for operating said striking means and for actuating said control means;
and means, operable by said control means, for returning said driven gear to its disengaged second position when said striking means has struck said predetermined number of strikes.

2. In a clock as recited in claim 1 wherein:
said control means comprises means actuable to limit said strikes to a predetermined number, corresponding to the particular hour position of the hour hand shaft, when the minute hand shaft is at the hour position.

3. In a clock as recited in claim 1 and comprising:
means, responsive to the minute hand shaft attaining the half-hour position, for moving said driven gear to its first position.

4. In a clock as recited in claim 3 wherein:
said control means comprises means actuable to limit said strikes to a constant predetermined number when the minute hand shaft is at the half-hour position.

5. In a clock as recited in claim 4 wherein:
said control means comprises means actuable to limit said strikes to a predetermined number, corresponding to the particular hour position of the hour hand shaft, when the minute hand shaft is at the hour position.

6. In a clock having an hour hand shaft and a minute hand shaft:
striking means operable to cause a sound;
control means actuable to limit to a predetermined number the strikes made by said striking means;
a constantly rotating gear;
a driven gear;
means mounting said driven gear for movement between a first position, in which said driven gear is in engagement with said constantly rotating gear, and a disengaged second position;
means normally urging said driven gear to said disengaged second position;
means, responsive to the minute hand shaft attaining a predetermined position, for moving said driven gear to its first position;
drivable means, driven by said driven gear when the latter is in its first position, for operating said striking means and for actuating said control means;
and means, operable by said control means, for returning said driven gear to its disengaged second position when said striking means has struck said predetermined number of strikes.

7. In a clock having an hour hand shaft and a minute hand shaft:
means for rotating said minute hand shaft;
rack means having a plurality of peripheral gear teeth;
means mounting said rack means for pivotal movement between a first position and a plurality of positions displaced from said first position in a first pivotal sense;
first biasing means normally urging said rack means to pivot in said first sense;
latch means for engaging with said peripheral gear teeth to prevent said rack means from pivoting in said first sense;
means mounting said latch means for movement between a first position in which said latch means engages with said peripheral gear teeth and a second, disengaged position;
second biasing means normally urging said latch means towards its first position;
means, responsive to rotation of said minute hand shaft between said half-hour and hour positions, for moving said latch means to its second position against the urging of the second biasing means;
first limiting means for limiting pivotal movement of said rack means in said fist sense, upon disengagement of said latch means, to a displaced position determined by the position of said hour hand shaft;
first drivable means for returning said rack means to its first position in incremental movements corresponding in number to the paticular hour position of said hour hand shaft, when said minute hand shaft attains the hour position;
striking means operable to cause a sound;
second drivable means for actuating said striking means when said minute hand shaft attains the hour position;
second limiting means for limiting the strikes of said striking means to the number of incremental movements of said rack;
a constantly rotating driving gear;
a driven gear;
means mounting said driven gear for movement between a first position in which the driven gear engages said driving gear, to the driven gear, and a disengaged, second position;

third biasing means normally urging said driven gear to its disengaged second position;

means, responsive to said minute hand shaft attaining the hour position, for moving said driven gear from its second to its first position;

and means drivingly connecting said driven gear to said first snd second drivable means to drive the drivable means when the driven gear is in its first position;

said second limiting means comprising means, responsive to the return of said rack means to its first position, for permitting the return of said driven gear from its first to its disengaged second position.

8. In a clock having an hour hand shaft and a minute hand shaft:

means for rotating said minute hand shaft;

rack means having a plurality of peripheral gear teeth;

means mounting said rack means for pivotal movement between a first position and a plurality of positions displaced from said first position in a first pivotal sense;

first biasing means normally urging said rack means to pivot in said first means;

latch means for engaging with said peripheral gear teeth to prevent said rack means from pivoting in said first sense;

means mounting said latch means for movement between a first position in which said latch means engages with said periperal gear teeth and a second, disengaged position;

second biasing means normally urging said latch means towards its first position;

means, responsive to rotation of said minute hand shaft between the half-hour and hour positions, for moving said latch means to its second position against the urging of the second biasing means;

first limiting means for limiting pivotal movement of said rack means in said first sense, upon disengagement of said latch means, to a displaced position determined by the position of said hour hand shaft;

first drivable means for returning said rack means to its first positon in incremental movements corresponding in number to the particular hour position of said hour hand shaft, when said minute hand shaft attains the hour position;

striking means operable to cause a sound;

second drivable means for actuating said striking means said minute hand shaft attains the hour position;

second limiting means for limiting the strikes of said striking means to the number of incremental movements of said rack;

said rack means comprising a partial tooth located next to said plurality of peripheral gear teeth in the direction of said first sense and an untoothed portion located next to said partial tooth;

said mounting means for said latch means comprising means mounting the latch means for movement between said first position for engaging said partial tooth and a third position for engaging said untoothed portion to prevent pivotal movement of said rack means in said first sense;

said second biasing means comprising means normally urging said latch means toward its third position;

means, responsive to the rotation of said minute hand shaft between the hour and half-hour positions, for moving said latch means for its first position;

said first biasing means comprising means for urging said rack means in a first pivotal sense to a displaced position in which said partial tooth is engaged by said latch means, when the latter moves from its third to its first position;

said second drivable means comprising means, actuable in response to the minute shaft attaining the half-hour position, for actuating said striking means;

said first drivable means comprising means, actuable in response to said minute hand shaft attaining the half-hour position, for returning said rack means to its first position in one movement;

said second limiting means comprising means, responsive to said rack means returning to its first position; for deactuating said first and second drivable means; and said second biasing means comprising means, responsive to the return of said rack means to its first position, for urging said latch means from its first to its third position.

9. In a clock as recited in claim 7 wherein said mounting means for the driven gear comprises:

arm means;

means on said arm means for carrying said driven gear;

a shaft;

and means mounting said arm means for pivotal movement, about the axis of said shaft, between first and second positions corresponding to said first and second positions of the driven gear.

10. In a clock as recited in claim 9 wherein:

said connecting means comprises a gear fixed on said shaft and engaging said driven gear to rotate said shaft; and said first drivable means comprises a disc fixed on said shaft and rotatable therewith, the tab means on said disc for engagement with said peripheral gear teeth on said rack means to pivot said rack means in a second sense, opposite said first sense, one incremental movement for each rotation of said disc.

11. In a clock as recited in claim 10 wherein:

said striking means comprises a striking arm, means pivotally mounting said striking arm for back and forth movement, and a projection on said striking arm;

and said second drivable means comprises a cam fixed on said shaft for rotation therewith, and means on said cam for engaging said projection to pivot said striking arm back and forth once for each rotation of said cam.

12. In a clock as recited in claim 7 wherein said means for moving said driven gear from its second to its first position comprises:

arm means;

means on said arm means for carrying said driven gear;

means mounting said arm means for movement between first and second positions corresponding to said first and second positions of the driven gear;

a member;

means mounting said member for movement between first and second positions;

cam means on said minute hand shaft for operating said member and for moving said member from its first to its second position in response to said minute hand shaft attaining the hour position;

and first engaging means on said member for engaging said arm means and moving the arm means from its second to its first position, to engage the driven gear with the driving gear, when said member moves from its first to its second position.

13. In a clock as recited in claim 12 and comprising:

means mounting said member for displacement between one disposition in which said first engaging means may engage said arm means and another disposition in which said first engaging means may not engage said arm means;

means normally maintaining said member in said one disposition; and second engaging means on said rack means for engaging said member, in response to the return of said rack means to its first position, to displace said member to said other disposition thereof;

said third biasing means comprising means for urging said arm means to return, with said driven gear, to their disengaged second positions when said member is displaced to its other disposition.

14. In a clock as recited in claim 7 wherein:

said first limiting means comprises a snail cam having twelve steps.

15. In a clock as recited in claim 1:

a clock mechanism including a first plate;

a striking mechanism, including said striking means, separate and discrete from said clock mechanism and located alongside said clock mechanism;

said striking mechanism including a second plate;

first gear means on said clock mechanism for rotating said hour hand shaft;

a further gear on said clock mechanism and driven by said fist gear means to rotate continuously at a constant speed;

said striking mechanism comprising control means for limiting to a predetermined number the strikes to be made by said striking mechanism;

second gear means on said striking mechanism for driving said control means;

a pin mounted on said second plate;

an opening on said first plate for receiving said pin and aligning the axis of said pin in predetermined relation to the axis of rotation of said further gear on the clock mechanism;

said second gear means comprising a linking gear mounted on said pin, for rotation about the axis of said pin, and engaging said further gear on said clock mechanism when said pin is received in said opening on said first plate.

16. In a clock as recited in claim 15 wherein:

said control means comprises a snail cam having twelve steps and an axis of rotation displaced from the axis of rotation of said hour hand shaft;

said second gear means comprising means for driving said snail cam.

17. In a clock as recited in claim 15 and comprising:

a synchronous electric motor for driving said first gear means.

18. In a clock having an hour hand shaft and a minute hand shaft:

a clock mechanism including a first plate;

a striking mechanism separate and discrete from said clock mechanism and located alongside said clock mechanism;

said striking mechanism including a second plate;

first gear means on said clock mechanism for rotating said hour hand shaft;

a further gear on said clock mechanism and driven by said first gear means to rotate continuously at a constant speed;

said striking mechanism comprising control means for limiting to a predetermined number the strikes to be made by said striking mechanism;

second gear means on said striking mechanism for driving said control means;

a pin mounted on said second plate;

an opening on said first plate for receiving said pin and aligning the axis of said pin in predetermined relation to the axis of rotation of said further gear on the clock mechanism;

said second gear means comprising a linking gear mounted on said pin for rotation about the axis of said pin and for meshing engagement with said further gear on said clock mechanism when said pin is received in said opening on said first plate.

19. In a clock as recited in claim 18 wherein:

said control means comprises a snail cam having twelve steps and an axis of rotation displaced from the axis of rotation of said hour hand shaft;

said second gear means comprising means for driving said snail cam.

20. In a clock as recited in claim 18 and comprising:

a synchronous electric motor for driving said first gear means.

* * * * *

UNITED STATES PATENT AND TRADEMARK OFFICE

CERTIFICATE OF CORRECTION

PATENT NO. : 4,036,004

DATED : July 19, 1977

INVENTOR(S) : Christian M. J. Jauch

It is certified that error appears in the above-identified patent and that said Letters Patent are hereby corrected as shown below:

Column 8, line 67, after "to", insert --rotate--.

line 48, change "fist", to --first--.

Column 9, line 23, change "means", to --sense--.

line 48, after "means", insert --when--.

line 68, after "means", delete "for" and insert --from its third to--.

Column 10, line 7, after "minute", insert --hand--.

line 36, delete "the" and insert --and--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*